US007051754B2

(12) United States Patent
Tsesarsky

(10) Patent No.: US 7,051,754 B2
(45) Date of Patent: May 30, 2006

(54) IMMEDIATE HOT WATER SUPPLY DEVICE

(76) Inventor: Yosef Tsesarsky, 16/5 Ha'rav Metzer St., Rechovot 78285 (IL)

( * ) Notice: Subject to any disclaimer, the term of this patent is extended or adjusted under 35 U.S.C. 154(b) by 0 days.

(21) Appl. No.: 10/859,722

(22) Filed: Jun. 3, 2004

(65) Prior Publication Data

US 2004/0244835 A1 Dec. 9, 2004

Related U.S. Application Data

(60) Provisional application No. 60/475,492, filed on Jun. 4, 2003.

(51) Int. Cl.
*F16K 49/00* (2006.01)

(52) U.S. Cl. ..... 137/337; 137/334; 137/338; 137/340; 137/341; 137/826

(58) Field of Classification Search ..... 137/334, 137/337, 338, 340, 341, 826
See application file for complete search history.

(56) References Cited

U.S. PATENT DOCUMENTS 4,160,461 A * 7/1979 Vataru et al. ..... 137/337
4,437,392 A * 3/1984 Stouffer ..... 454/125
4,517,881 A * 5/1985 Stouffer ..... 454/125
4,697,614 A * 10/1987 Powers et al. ..... 137/337
5,098,194 A * 3/1992 Kuo et al. ..... 366/144
5,103,897 A * 4/1992 Cullimore et al. ..... 165/274

* cited by examiner

*Primary Examiner*—A. Michael Chambers
(74) *Attorney, Agent, or Firm*—Angenehm Law Firm, Ltd; N Paul Friederichs

(57) ABSTRACT

In a hot water distribution system, the water oscillation in hot water supply line maintains hot water line in heated condition by ensuring heat transfer from the water heater to a hot water line executing regenerative heat transfer technique. Fulfillment of longitude water oscillations is ensured by installation of at least two flexible elements such as pressure air accumulators, wherein one is connected to water heater reservoir, and another is connected to hot water line in vicinity to most remote hot water fixture.

This can be combined with one of pressure air accumulators initiator of water oscillations that is used for initiation and maintaining of the water oscillation. Heat spreads through the hot water line ensuring hot state of water near all fixtures of the line ensuring instantaneous hot water supply at moment of tap opening.

11 Claims, 4 Drawing Sheets

IMMEDIATE HOT WATER SUPPLY DEVICE

The present invention relates to a provisional patent application Ser. No. 60/475,492 filed at the United States patent and trademark office on the $4^{th}$ of Jun. 2003.

FIELD OF THE INVENTION

The present invention is related to hot water distribution systems. More particularly, the present invention is related to immediate hot water delivery systems.

BACKGROUND OF THE INVENTION

In many hot water supply systems, such as ones used in homes, the start of hot water consumption mostly includes loss of immense amount of water, inconvenience and even chill during waiting for hot water arrival to the tap.

In known immediate hot water delivery system, hot water line from the heater to the tap is kept from chilling by circulation or by reciprocation of hot water between hot and cold water pipes.

Closest patent based on circulation principle is aspirator water circulation apparatus disclosed in European Patent Application EP 0 809 079 A1. U.S. Pat. No. 6,026,844 is related to storing hot water in an insulated reservoir and after the stored volume returns to the system, storing is repeated. U.S. Pat. No. 6,227,235 teaches a reciprocate circulation of water between hot and cool lines. Main disadvantages of commercially available circulation and reciprocation instantaneous hot water delivery are high production cost, high electricity consumption, and poor service characteristic. No analogues based on heat transfer along hot water lines have been found.

SUMMARY OF THE INVENTION

Heat transfer from water heater into hot water line in accordance with regenerative heat transfer technique ensures instantaneous hot water delivery to hot tap even when taps are closed in position. The process is maintained by longitude water oscillations, caused by inserting at least two flexible elements into the hot water system: an air pressure accumulator and a water oscillations initiator.

It is an object of the present invention to provide immediate hot water supply device with a longitude heat transfer that ensures at least one of the following: good service, hot water temperature is close to that of heater water, significantly low cost, less power consumption, and easy installation.

It is another object of the present invention to provide an immediate hot water supply device that is produced without a motor, in absence of pump and the electrical power is small because it only maintains natural water oscillations in the pipe.

BRIEF DESCRIPTION OF THE DRAWINGS

An exemplary embodiment of the invention is described in the following section with respect to the drawings. The same reference numbers are used to designate the same or related features on different drawings. The drawings are generally not drawn to scale.

DETAILED DESCRIPTION OF EXEMPLARY EMBODIMENTS

The following detailed description is of the best presently contemplated modes of carrying out the present invention. This description is not to be taken in a limiting sense, but is made merely for the purpose of illustrating the general principles in accordance with the present invention. The scope of the present invention is best defined by the appended claims.

Figure 1:
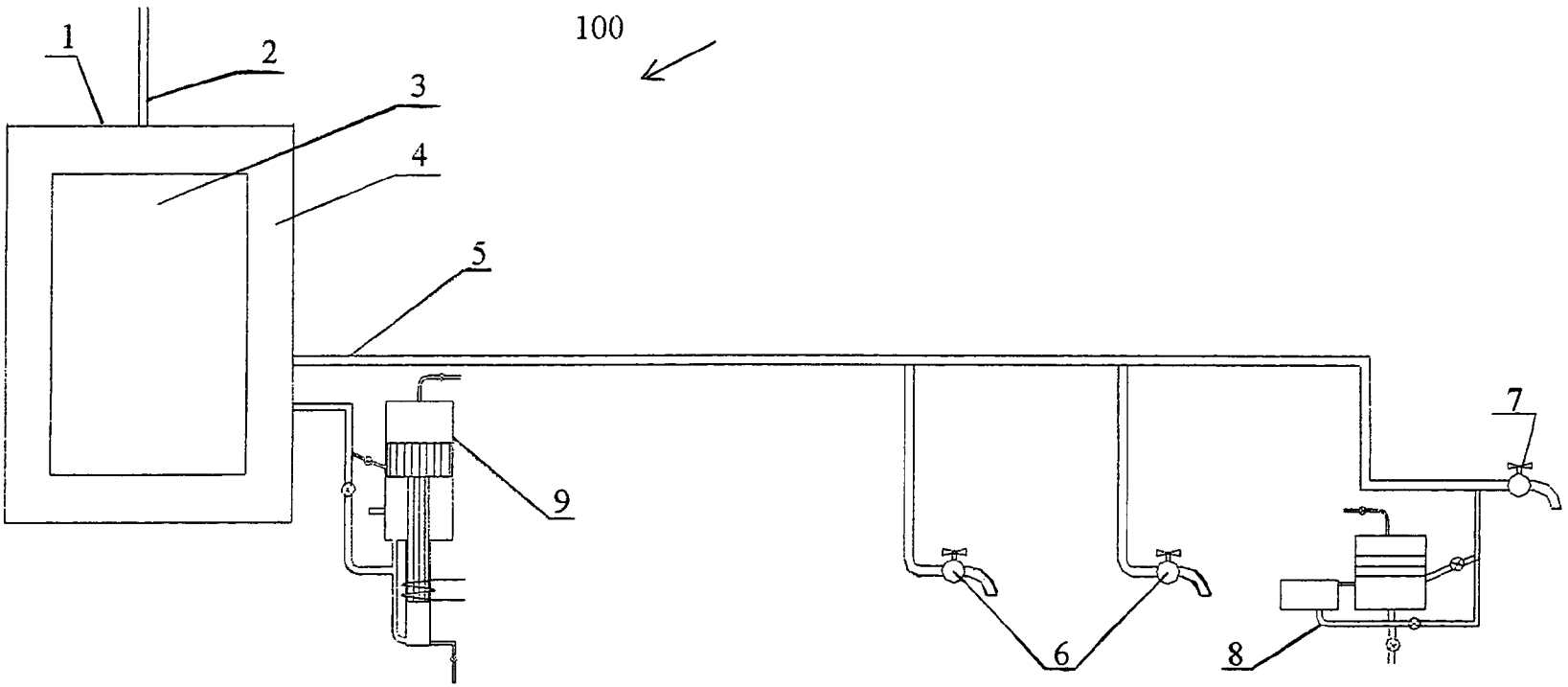
FIG. 1 illustrates an immediate water supply system in accordance with a preferred embodiment of the present invention.

Reference is now made to FIG. 1 illustrating an immediate water supply system in accordance with a preferred embodiment of the present invention. Immediate hot water delivery system 100 comprises water heater 1 that is connected to cold water supply by line 2 and includes oil or gas burner or other built in heating element 3, which heats water in water heater reservoir 4. Hot water reservoir 4 is connected to hot water line 5 that delivers hot water to one or several optional hot water taps 6. Tap 7 is the most remote hot water supply fixture of line 2.

If all taps on line 2 are in closed position, the temperature of water in the line will reach an ambient temperature. Starting the flow of hot water from a tap causes loss of some water before it become suitable for use. Besides water loss, waiting create inconvenience in the customer's side and sometimes chill of people in bathroom. The use of cold water instead of hot water in kitchen often provokes dermatitis of housewife hands.

It is an object of the present invention to ensure immediate water supply to all fixtures. Air pressure accumulator 8 provided in the system and connected to the hot water line 5 in vicinity of most remote tap 7. Water oscillations initiator 9 consists of air pressure accumulator, combined with water oscillations driver is inserted in water supply system 100 and is fluidically connected to heater reservoir 4. Water oscillations initiator 9, together with air pressure accumulator 8 creates longitude oscillation for water between heater reservoir 4 and remote air pressure accumulator 8. Oscillating system that is organized by elastic supports, air chambers of pressure accumulator 8 and water oscillations initiator 9 together with mass of pipe water used to oscillate water and to fulfill regenerative heat transfer along the hot water line that heats water using heat of water heater.

Optionally, cold water supply by line 2 is connected to the bottom of water heater 1. Optionally, cold water supply by line 2 is equipped with non-return valve (not shown) that prevents hot water from heater 1 to return into the cold water system. Optionally, heater 1 is equipped with a safety pressure release valve preventing system rupture due to overpressure.

Optionally, hot water line 5 is connected to the top portion of heater 1, where the water temperature is higher.

Optionally, oscillations initiator 9 is connected to cold water line 2, close to heater 1. In this configuration, oscillations initiator 9 is connected between heater 1 and the optional non-return valve.

An advantage of the above-described system is that it can easily installed in existing hot water systems converting them to immediate hot water delivery systems.

In contrast to water circulation method, no return water pipes need to be installed. Oscillations initiator 9 may easily be installed near the water heater, where electric power supply is readily available. Air pressure accumulator 8 may be installed out of sight under the kitchen sink.

If more than one hot water lines 5 are used or if hot water line 5 is branches, it is preferable to install an air pressure accumulator near each of the terminal most remote tap 7.

Alternately, the locations of oscillations initiator 9 and air pressure accumulator 8 may be reversed.

Figure 2:
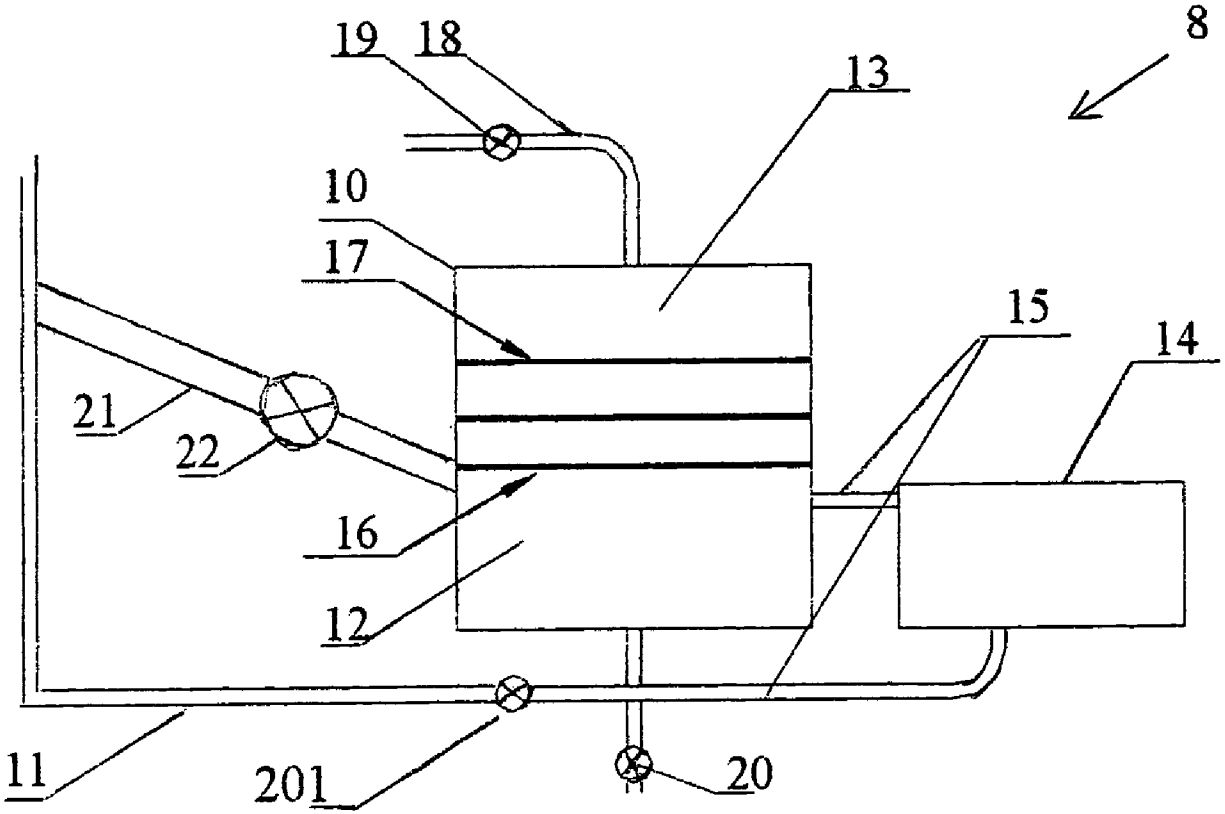
FIG. 2 illustrates air pressure accumulator in accordance with a preferred embodiment of the present invention.

Reference is now made to FIG. 2 illustrating air pressure accumulator in accordance with a preferred embodiment of the present invention. The figure shows details of an exemplary embodiment of air pressure accumulator 8. Pressure accumulator 8 consists of air chamber that is connected to hot water line 5 by connection pipe 11. Bottom part of chamber 10 filled by water 12. Pressed air 13 is filled in the upper portion of the chamber. Optionally, additional tank 14 is connected to chamber 10 by optional connection lines 15. The water level oscillates between minimal level 16 and maximal level 17. Optional air tube 18 and optional air valve 19 may be connected to the top part of chamber 10. Drain valve 20 is optionally placed on lower part of pressure accumulator 8.

Optional oblique tube 21 is equipped by valve 22 that is open if the system is under the working pressure and is closed if pressure is low. The switch of the valve is provided by standard pressure relay. Tube 21 is connected to chamber 10 in vicinity of minimal water level 16.

Optional separation valve 201 on connection pipe 11 may be closed to separate the pressure accumulator 8 from the hot water line 5 for maintenance, as an example.

Alternatively, the function of pressure accumulator 8 may be achieved by using a cylinder and piston system where the piston is moved by the water pressure against air pressure on the other side or against a spring. Elastic membrane may replace the piston in this configuration.

Figure 3:
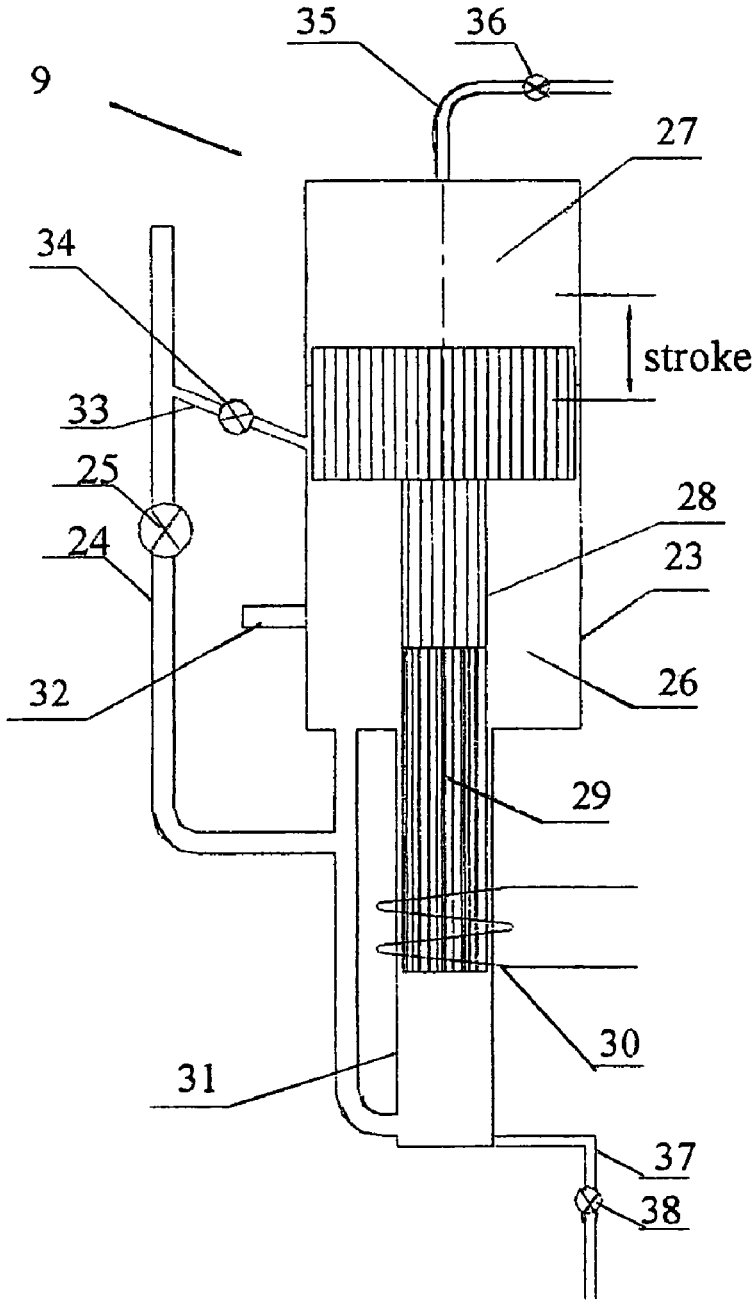
FIG. 3 illustrates a water oscillations initiator in accordance with a preferred embodiment of the present invention.

Reference is now made to FIG. 3 illustrating a water oscillations initiator in accordance with a preferred embodiment of the present invention. The figure shows details of an exemplary embodiment of water oscillation initiator 9.

Water oscillation initiator 9 comprises hermetic cylinder 23 that is connected to heater 1 by connection pipe 24, optionally equipped with valve 25. The bottom part of the cylindrical core 23 is filled by water 26, while upper part of the cylinder filled by pressed air 27. Water oscillation initiator 9 includes piston 28 that separates air and water that fill parts of cylinder 23. Optionally piston 28 is made of light material, thus it remains in this position by its floatage properties.

Optionally, radial clearance between piston 28 and the internal walls of cylinder 23 is between 0.2 and 0.3 mm to avoid semidry friction. Alternatively, piston 28 may be substantially the same diameter as the inner diameter of the cylinder and optionally fitted with O-rings or other means for preventing water 26 from entering air 27. Piston 28 is mechanically connected to magnetic frame 29 of electromechanical pulse driver.

Pulse driver comprises magnetic frame 29, winding 30 and feedback and automation electric circuitry (not shown). At least part of the cylindrical core 31 between the winding 30 and magnetic frame 29 is made of material that facilitates the conduction of magnetic field created by varying electric current in the winding to the magnetic frame, thus affecting force on the piston. Water oscillation initiator 9 optionally includes sockets 32 that provide option to connect with additional oscillation initiator.

Optional oblique tube 33 is equipped with valve 34 that is open if the system is under working pressure and is closed if pressure is low. The switch of the valve is provided with standard pressure relay. Optional tube 33 is connected to the cylinder in vicinity of minimal water level in cylinder 23.

Optional air tube 35 and air valve 36 are connected to the top part of cylinder 23.

Optionally, drain valve 37 is placed on drain passage 38 optionally connected to lower part of the oscillation initiator.

Valves 201, 19, 36 and 38 are used for installation and maintenance.

Electromechanical pulse driver is built of standard blocks usually used in electronics for the purpose of operating the oscillations initiator.

Mechanical pulses of the driver in one or both dead position(s) ensures water pushing, maintaining continuous back-and-forth motion of water inside hot water pipe 5 between heater and air pressure accumulator 9 installed in vicinity of most distant hot tap 7.

Optionally, automation facilities (not shown) ensure synchronizing of mechanical pulses with frequency of natural oscillations of water mass on two elastic supports i.e. air accumulators 8 and oscillation initiator 9. Water oscillation and heat transfer along the pipe will be maintained with minimum influx of energy. Automation facilities ensure also an initial pulse to start water oscillations.

Volume of air in each accumulator varies dependant of pressure in water supply system 100 and may be regulated by additional tanks 14 (shown in FIG. 2). Volume of air may be adjusted according to the length and diameter of hot water pipe 5. Similarly, the stroke of the piston may be adjusted.

Air chambers charging is executed by pouring water in previously empty chambers or cylinders.

Water rising from the bottom into empty chamber or cylinder presses air in the chamber and displaces it into the top portion of the chamber or cylinder.

The optional use of additional tanks 14 creates facility to correct and correct air volume to produce oscillating system that keeps optimal frequency of natural oscillations and optimal amplitude of oscillations within allowances. This charging method ensures automatic charging after deterioration of water supply.

Optionally, if additional air will liberate from water the optional oblique passages 21 or 33, which are equipped with valves 22 and 34, respectively that are open if system is under working pressure and are closed if pressure is low will put excessive air into water supply system. The connection point of the optional oblique passages 21 and 33 may be adjusted to the working conditions of the system during installation.

Alternatively, the function of oscillation initiator 9 may be achieved by using any type of pump. For example, but not limited to a cylinder and piston system, the piston can move by a motor. Elastic membrane may replace the piston in this configuration.

Figure 4:
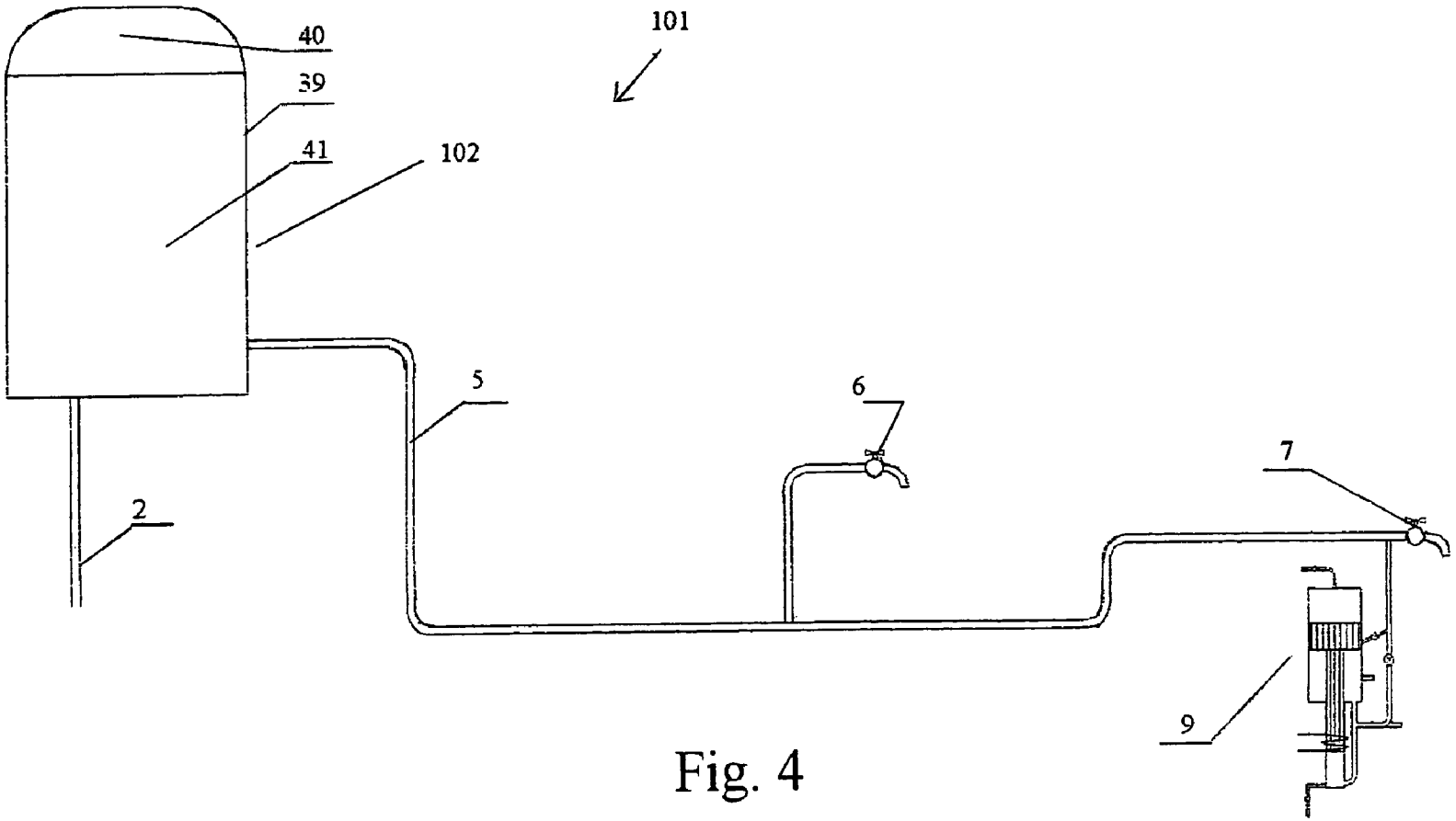
FIG. 4 illustrates an immediate water supply system in accordance with another preferred embodiment of the present invention.

Reference 1 snow made to FIG. 4 illustrating an immediate hot water supply device in accordance with another preferred embodiment of the present invention. In this embodiment, hot water heater 102 includes hot water reservoir 39 which contains air filled volume 40 at the top. The volume is used as elastic element at the heater side of hot water line 5. Hot water 41 is supplied by hot water line 2 to hot water tap(s) 6 including most remote fixture of the line 7.

Water oscillation initiator 9 is connected to pipe in vicinity of most remote tap 7.

Hot water oscillating is maintained by elastic air volume of heater tank and water oscillations initiator 9 with its air chamber together with mass of water in the pipe, thus fulfilling regenerative heat transfer along hot water line that heats water using the heat of water heater.

If more than one hot water lines 5 are used or if hot water line 5 is branches, it is preferable to install a Water oscillation initiator near each of the terminal most remote tap 7.

Alternately or additionally, an air filled balloon may be inserted into hot water heater 102 inside the hot water reservoir 39.

Optionally, cold water supply by line 2 connected to heater 102 is equipped with non-return valve (not shown), which prevents hot water from heater 1 to return into the cold water system. Optionally heater 101 is equipped with a safety pressure release valve preventing system rupture due to overpressure.

Optionally, hot water line 5 is connected to the top of heater 1, where the water temperature is higher.

While the invention has been described with reference to certain exemplary embodiments, various modifications will be readily apparent to and may be readily accomplished by persons skilled in the art without departing from the spirit and scope of the above teachings.

It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art.

It is noted that some of the above described embodiments may describe the best mode contemplated by the inventors and therefore include structure, acts or details of structures and acts that may not be essential to the invention and which are described as examples. Structure and acts described herein are replaceable by equivalents which perform the same function, even if the structure or acts are different, as known in the art. Therefore, the scope of the invention is limited only by the elements and limitations as used in the claims. The terms "comprise", "include" and their conjugates as used herein mean "include but are not necessarily limited to".

The invention claimed is:

1. An immediate hot water supply device for a hot water distribution system in which hot water is delivered through a hot water line from a water heater to hot water taps, the water supply device comprising:

means for longitudinal heat transfer that comprises elastic elements connected to the water heater and to the hot water line and adapted to allow water oscillations along the hot water line;

means for initiating water oscillation adapted to produce oscillations of water in the hot water line;

whereby the immediate hot water supply device ensures instantaneous hot water supply to the hot water taps.

2. The device as claimed in claim 1, wherein said elastic elements are selected from a group of elements such as pressure air accumulators and air filled volumes.

3. The device as claimed in claim 2, wherein said air pressure accumulator is connected to the hot water line in vicinity of most remote tap.

4. The device as claimed in claim 2, wherein said air filled volume is provided at the top of the water heater, and wherein said air filled volume is used as elastic element at the heater side of the hot water line.

5. The device as claimed in claim 1, wherein said initiator of water oscillations is connected to the hot water line in vicinity of most remote fixtures.

6. The device as claimed in claim 1, wherein said initiator of water oscillations is connected to the water heater.

7. The device as claimed in claim 1, wherein said initiator of water oscillations is combined with pressure air accumulator that comprises piston and magnet frame mounted inside said pressure air accumulator and winding and electric scheme mounted outside said pressure air accumulator.

8. The device as claimed in claim 1, wherein said initiator of water oscillations comprises a piston placed inside a cylinder that separates water in the bottom of said cylinder and air at the top of said cylinder.

9. The device as claimed in claim 8, wherein in said initiator of water oscillations a winding of a driver is placed outside said cylinder and is separated from said magnet frame by insulation wall, electrical driver having feedback that synchronizes mechanical pulses of said driver with frequency of natural oscillations of water in oscillating system that organize together elastic supports, air pressure accumulators and pipe water, wherein electrical driver comprises means of impulse driving to improve mechanical driver efficiency.

10. The device as claimed in claim 1, wherein in said air pressure accumulator in which a cylinder has additional volume that in process of charging by water of previously dry accumulator contains atmospheric air pressure and wherein air is pressed during filling of the accumulator by water to achieve proper air pressure and air volume in top of accumulator obtaining necessary frequency of natural oscillation of water in the hot water line and the additional volume might be made removable or easily regulated to adjust changed by a valve.

11. A water heating system comprising:

a water reservoir and a heating device for heating water contained in said water reservoir, a water pipe in fluid communication with said water reservoir for communicating water from said water reservoir to a remote location, such as a tap, and a mechanism located at said remote location for increasing heat transfer, so as to bring the temperature of water in said pipe and at said remote location to about the temperature of water contained in said reservoir, wherein said mechanism comprises means for initiating water oscillation along said water pipe.

* * * * *